US008016136B2

(12) United States Patent
Kainuma et al.

(10) Patent No.: US 8,016,136 B2
(45) Date of Patent: Sep. 13, 2011

(54) SHOWCASE

(75) Inventors: Hidekazu Kainuma, Kumagaya (JP); Koji Hayase, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 628 days.

(21) Appl. No.: 11/242,789

(22) Filed: Oct. 5, 2005

(65) Prior Publication Data

US 2006/0076304 A1 Apr. 13, 2006

(30) Foreign Application Priority Data

Oct. 8, 2004 (JP) ..... 2004-295904

(51) Int. Cl.
*A47F 5/08* (2006.01)

(52) U.S. Cl. ..... 211/90.01

(58) Field of Classification Search ..... 211/90.01, 211/187; 312/116, 128, 405.1, 321.5, 351; 108/27, 181, 180
See application file for complete search history.

(56) References Cited

U.S. PATENT DOCUMENTS 1,910,773 A * 5/1933 Richter ..... 312/117
2,563,746 A * 8/1951 Ressinger ..... 312/127
3,212,755 A * 10/1965 Liss et al. ..... 256/65.16
(Continued)

FOREIGN PATENT DOCUMENTS

JP 8-196395 8/1996
(Continued)

OTHER PUBLICATIONS

Patent Abstracts of Japan vol. 1996, No. 06, Jun. 28, 1996 & JP 08 029053 A (Hoshizaki Electric Co Ltd), Feb. 2, 1996 *abstract*.
(Continued)

*Primary Examiner* — Sarah Purol
(74) *Attorney, Agent, or Firm* — Kratz, Quintos & Hanson, LLP

(57) ABSTRACT

An object is to provide a showcase in which an attaching height of a guard for preventing falling of goods can be easily changed without changing a shelf guard member for preventing the falling of the goods depending on a height of the goods. The showcase is constituted by bridging shelves for displaying the goods to front and rear supports comprising a plurality of vertically ranging engagement holes, and comprises the guard for preventing falling of goods, disposed above an edge portion of each shelf. This guard for preventing the falling of the goods comprises: a guard main body constituted of a stria or the like; and a guard receiver having a guard holding portion, and the guard main body is disengageably attached to the engagement holes formed in the front support via the guard receiver.

6 Claims, 9 Drawing Sheets

U.S. PATENT DOCUMENTS

| | | | | |
|---|---|---|---|---|
| 3,709,576 | A * | 1/1973 | Lemoine | 312/321.5 |
| 4,045,043 | A * | 8/1977 | Fourrey | 280/79.3 |
| 4,086,857 | A * | 5/1978 | Igarashi et al. | 108/106 |
| 4,291,928 | A * | 9/1981 | Kiyosawa | 312/140 |
| 4,368,936 | A * | 1/1983 | Worrallo | 312/140 |
| 4,444,322 | A * | 4/1984 | Lee | 211/190 |
| 4,723,618 | A * | 2/1988 | Coonradt | 180/68.5 |
| 4,768,845 | A * | 9/1988 | Yeh | 312/257.1 |
| 4,865,402 | A * | 9/1989 | Walter | 312/140 |
| D315,459 | S * | 3/1991 | Young et al. | D6/465 |
| 5,083,844 | A * | 1/1992 | Gruenberg et al. | 312/140 |
| 5,771,959 | A * | 6/1998 | Westbrooks et al. | 165/11.1 |
| 7,205,508 | B2 * | 4/2007 | Sakanoue et al. | 219/403 |
| 7,314,258 | B2 * | 1/2008 | Sakanoue | 312/139 |
| 2004/0178711 | A1 * | 9/2004 | Avendano | 312/405.1 |
| 2006/0049726 | A1 * | 3/2006 | Hayase et al. | 312/128 |
| 2006/0076304 | A1 * | 4/2006 | Kainuma et al. | 211/90.01 |
| 2008/0018209 | A1 * | 1/2008 | Hayase et al. | 312/102 |
| 2010/0127604 | A1 * | 5/2010 | Ceballos-Godefroy | 312/117 |

FOREIGN PATENT DOCUMENTS

| | | |
|---|---|---|
| JP | 2001-087097 | 4/2001 |
| JP | 2001-128766 | 5/2001 |
| JP | 2003-159136 | 6/2003 |
| JP | 2003-225126 | 8/2003 |

OTHER PUBLICATIONS

European Search Report dated Feb. 16, 2006.

Office Action dated Jul. 20, 2010 corresponding to Japanese patent application No. 2004-295904.

* cited by examiner

SHOWCASE

BACKGROUND OF THE INVENTION

The present invention relates to a showcase in which goods such as canned beverages or plastic-bottled beverages are laid on shelves for displaying the goods.

Heretofore, this type of showcase has been installed in a store such as a supermarket or a convenience store, and used for displaying and dispensing goods. Especially, as a hot dispensing showcase for warming and dispensing a canned beverage or a plastic-bottled beverage, for example, there is a showcase 100 shown in FIG. 9. The showcase 100 comprises a display chamber 102 whose periphery is surrounded with transparent glass 101. In an upper part of the display chamber 102, there are disposed a plurality of stages of shelves 103 each including a heater (not shown) on a lower surface thereof. In a lower part of the display chamber 102, there are disposed a plurality of stages of shelves 104 constituted of racks, and goods are displayed on these shelves 103, 104. A front surface and/or a rear surface of the display chamber 102 is openably closed by a door 105 made of transparent glass. The shelves 103, 104 are supported by shelf supports 106 vertically disposed in four corners of the display chamber 102.

Here, each of the shelves 103 bridged to the upper part of the display chamber 102 comprises: a metal plate 103A; and a frame member 103B disposed on a peripheral edge of the metal plate, and a shelf guard 107 fixed to the frame member 103B by spot welding or the like is disposed on a front edge of each shelf 103. Accordingly, the goods displayed on the shelves 103 are prevented from falling in advance.

On the other hand, the shelves 104 bridged to the lower part of the display chamber 102 comprise racks. As shown in FIG. 9, peripheral edges of the shelves are slightly bent upwards, and prevent the falling of the goods displayed on the shelves 104 in advance.

Moreover, in addition, a wire extending in a horizontal direction above a front end portion of each shelf plate is fixed to the shelf plate by the spot welding or the like. Accordingly, the falling of the goods displayed on the shelves is prevented in advance (see, e.g., Japanese Patent Application Laid-Open No. 8-196395).

However, since goods falling preventing means such as the shelf guard disposed on the conventional shelf is positioned only in a predetermined height from a shelf upper surface, there has been a problem that it is not possible to cope with goods height dimensions diversified nowadays. Therefore, it is necessary to prepare shelves provided with shelf guards in height dimensions corresponding to those of goods such as a 500 ml plastic-bottled beverage, a 350 ml plastic-bottled beverage, and a 50 ml bottled beverage for use in nutrition supplement drink. In this case, every time the beverages to be laid are changed, they have to be disadvantageously changed together with the shelves.

Therefore, it is proposed that the shelf guards be detachably inserted and fixed to the shelves, and the shelf guard having a height corresponding to the height dimension of the goods be selected and used. However, there is a problem that a plurality of shelf guards have to be prepared in order to adjust the heights. When the shelf guard is inserted and fixed to the shelf upper surface, a force applied to a shelf front part is concentrated on a portion into which the shelf guard is inserted. Therefore, especially strengths of the shelf guard and the shelf itself need to be enhanced, and the shelf itself might break as the case may be.

SUMMARY OF THE INVENTION

The present invention has been developed in order to solve such conventional technical problems, and an object thereof is to provide a showcase in which an attaching height of a guard for preventing falling of goods can be easily changed without changing a shelf guard member depending on heights of the goods.

According to a first aspect of the present invention, there is provided a showcase constituted of shelves for displaying goods, which are bridged to supports comprising a plurality of vertically ranging engagement holes, and comprising a guard for preventing falling of the goods, which is disposed above an edge portion of each shelf, wherein the guard for preventing the falling of the goods is detachably attached to the engagement holes.

According to a second aspect of the present invention, in the above-described invention, the guard for preventing the falling of the goods comprises: a guard main body extending over a longitudinal direction of each shelf; and a guard receiver which receives the guard main body and which is detachably attached to the engagement holes.

According to a third aspect of the present invention, in the above-described invention, the guard receiver comprises: a plurality of engaging claws engaged with the plurality of engagement holes, respectively.

According to a fourth aspect of the present invention, in the second or third aspect of the present invention, the guard receiver has a guard holding portion which holds the guard main body, and the guard holding portion opens toward the inside of the shelf to hold the guard main body.

According to a fifth aspect of the present invention, in the second or third aspect of the present invention, the guard receiver has a guard holding portion which holds the guard main body, and the guard holding portion opens upwards to hold the guard main body.

In the first aspect of the present invention, in the showcase in which the shelves for displaying the goods are bridged to the supports comprising the plurality of vertically ranging engagement holes, the guard for preventing the falling of the goods is disposed above the edge portion of each shelf, and the guard for preventing the falling of the goods is detachably attached to the engagement holes. Therefore, the guard for preventing the falling of the goods can be attached using the engagement holes which hold the shelf.

Therefore, the guard for preventing the falling of the goods does not have to be especially disposed on the shelf. Even in a case where the goods having different height dimensions are displayed on the shelves, the guard does not have to be changed depending on sizes of the goods. When the attaching height of the guard for preventing the falling of the goods is changed, the goods falling prevention can be realized depending on the heights of the respective goods.

According to the second aspect of the present invention, in the above-described invention, the guard for preventing the falling of the goods comprises: the guard main body extending over the longitudinal direction of each shelf; and the guard receiver which receives the guard main body. The guard receiver is detachably attached to the engagement holes. Therefore, the guard main body can be attached via the guard receiver, and the guard can be stably held in the engagement holes of the supports. Consequently, the falling of the goods displayed on the shelf can be more securely prevented.

According to the third aspect of the present invention, in the above-described invention, the guard receiver comprises: the plurality of engaging claws engaged with the plurality of engagement holes, respectively. Therefore, the guard receiver can be more securely engaged with the engagement holes of the supports. Consequently, an attached state of the guard itself is stabilized, and the falling of the goods displayed on the shelf can be more securely prevented.

According to the fourth aspect of the present invention, in the second or third aspect of the present invention, the guard receiver has the guard holding portion which holds the guard main body, and the guard holding portion opens toward the inside of the shelf to hold the guard main body. Therefore, even in a case where the goods are pushed forward, it is possible to avoid beforehand a disadvantage that the guard for preventing the falling of the goods, disposed on the front surface, is pushed forward, and easily detaches from the guard receiver.

According to the fifth aspect of the present invention, in the second or third aspect of the present invention, the guard receiver has the guard holding portion which holds the guard main body, and the guard holding portion opens upwards to hold the guard main body. Therefore, the guard main body can be easily attached/detached with respect to the guard holding portion still in a state in which the goods are displayed on the shelves. While the goods are displayed, it is possible to change the height of the guard for preventing the falling of the goods.

DETAILED DESCRIPTION OF THE PREFERRED EMBODIMENT

Embodiments of the present invention will be described hereinafter with reference to the drawings. It is to be noted that a showcase 1 described in the following embodiments is a so-called desk top type hot and cold showcase (cooling/warming switchable usable showcase) which is disposed in a store such as a convenience store and which dispenses a plastic-bottled beverage or a canned beverage such as coffee or tea while cooling or warming it.

Figure 1:
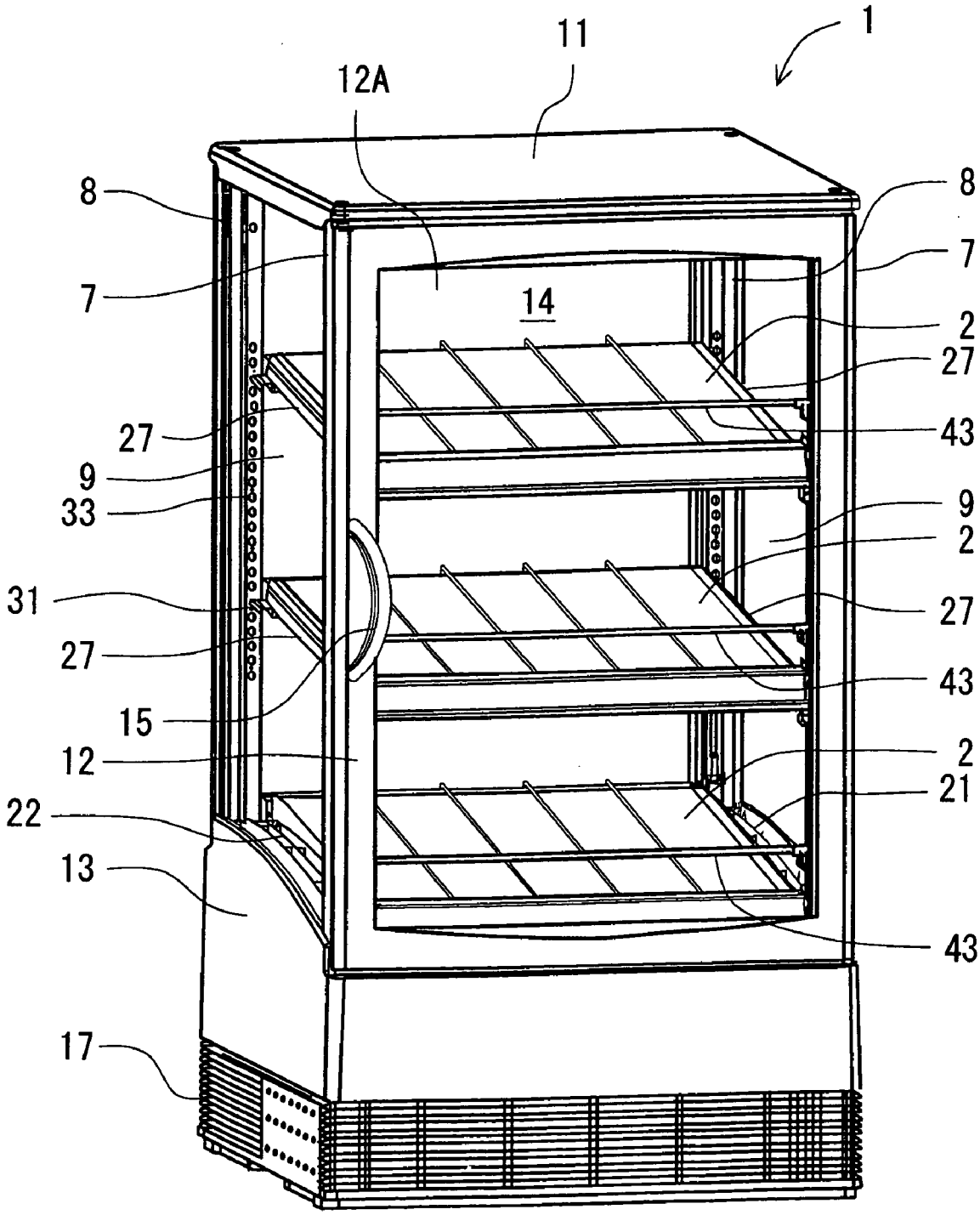
FIG. 1 is a perspective view of a showcase according to an embodiment to which the present invention is applied.
Figure 2:
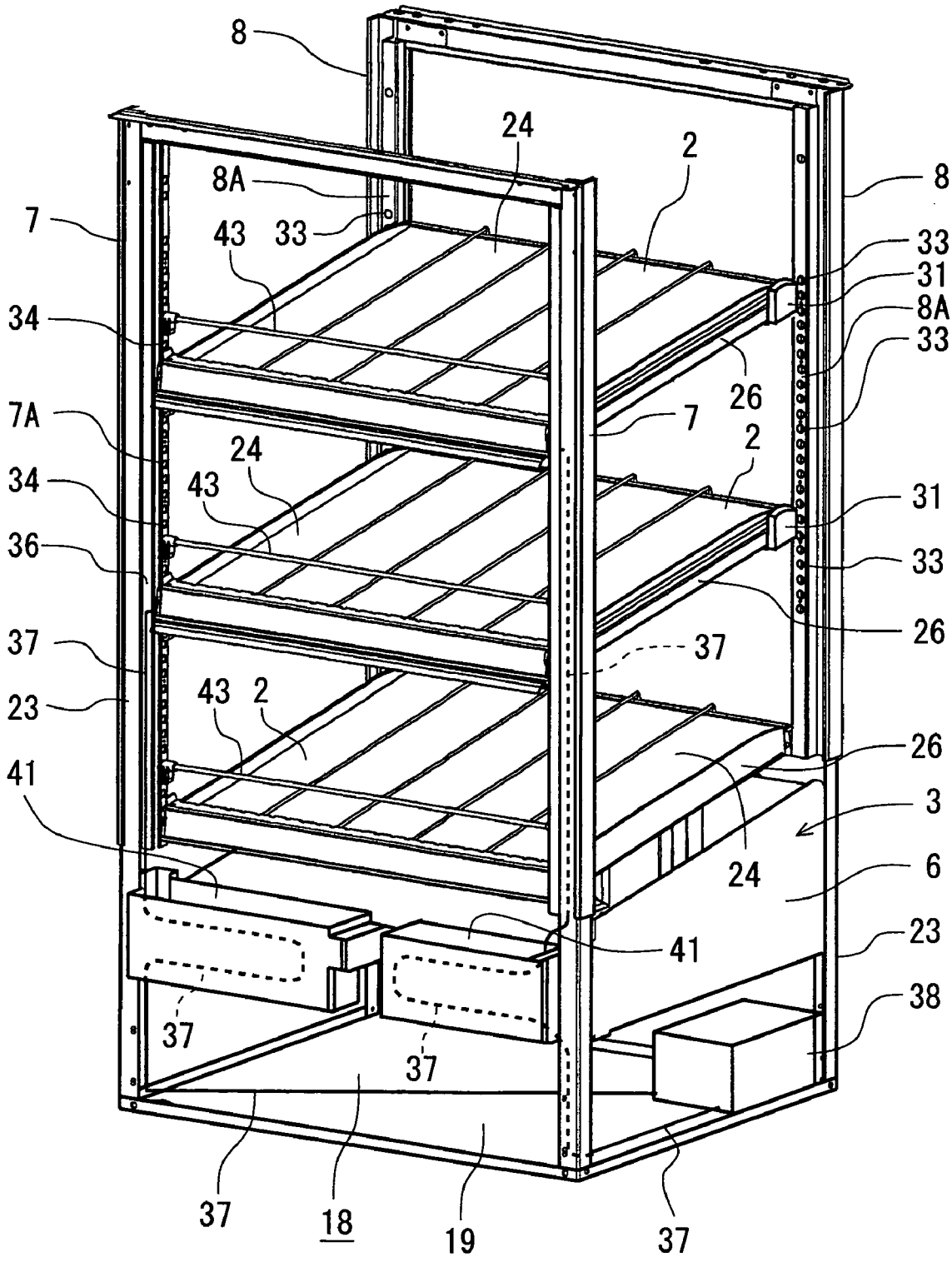
FIG. 2 is a perspective view showing an internal structure of the showcase of FIG. 1.
Figure 3:
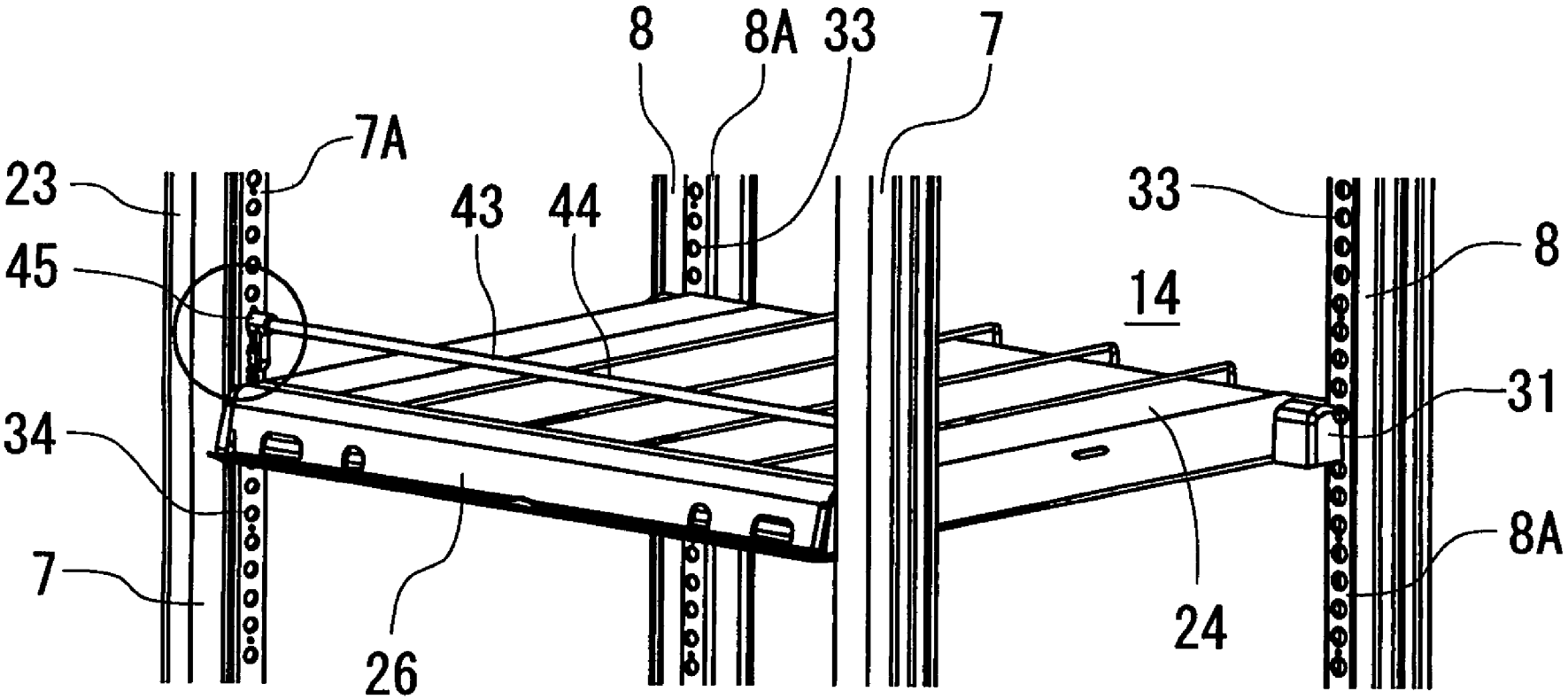
FIG. 3 is a partially enlarged perspective view of the showcase of FIG. 1.
Figure 4:
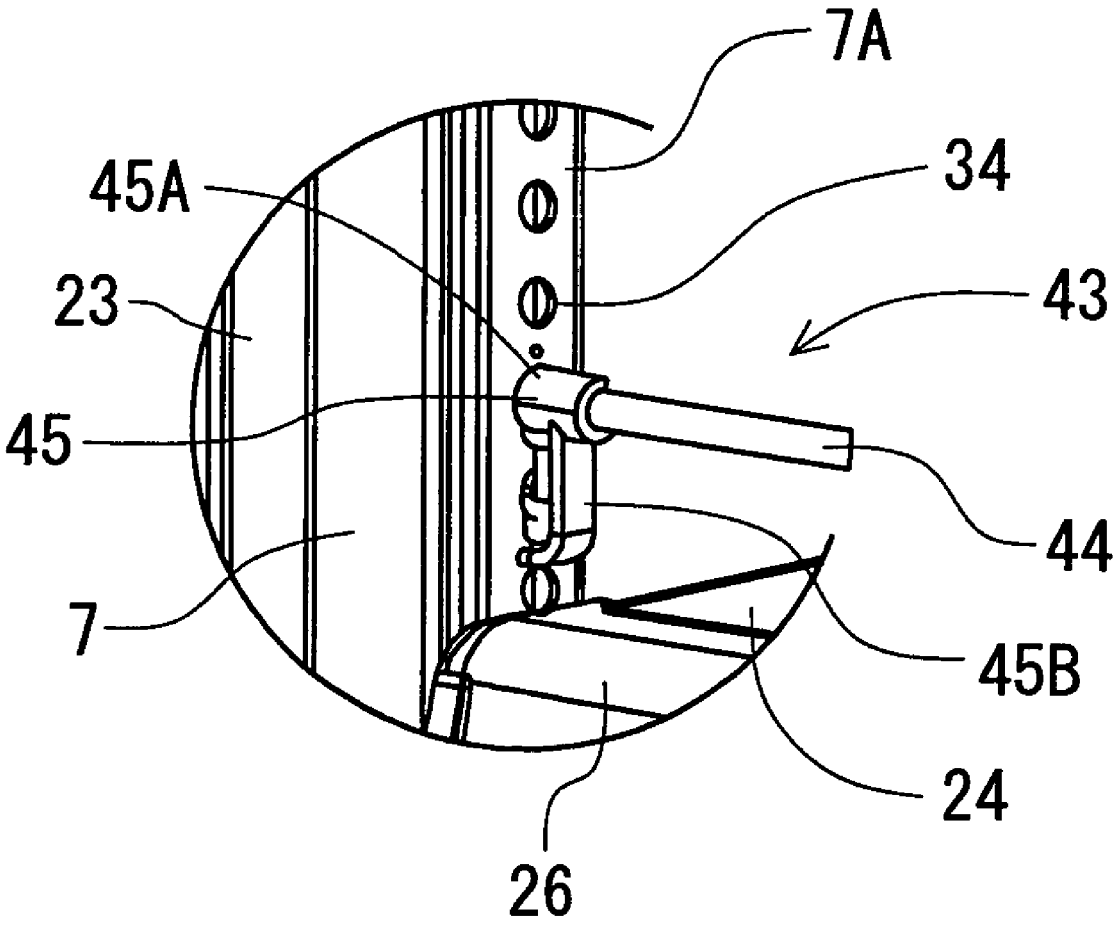
FIG. 4 is a partially enlarged diagram of FIG. 3.

This is, FIG. 1 shows a perspective view of the showcase 1 according to an embodiment to which the present invention is applied, FIG. 2 shows a perspective view showing an internal structure of the showcase 1, FIG. 3 shows a partially enlarged perspective view of the showcase 1, and FIG. 4 shows a partially enlarged diagram of FIG. 3, respectively. A main body 3 of the showcase 1 of the embodiment comprises: an insulating wall (not shown) made of foamed polyurethane; and a case 6 surrounding a periphery of the insulating wall and made of a hard synthetic resin. Moreover, front supports 7, 7 and rear supports 8, 8 are vertically disposed in four corners of the main body 3, right and left vertically long transparent walls 9, 9 made of transparent insulating glass are supported by the supports 7, 7, 8, and 8, and a ceiling wall 11 is attached to an upper part.

Moreover, a vertically long door 12 (rear door is not shown) as a transparent wall in which transparent insulating glass 12A is fit is rotatably supported by each of the right front support 7 viewed from front and the left rear support 8 viewed from rear. On the main body 3, a display chamber 14 is constituted which is surrounded with the transparent walls 9, 9, the doors 12, 12, and the ceiling wall 11. Moreover, the doors 12, 12 openably close openings in front and rear surfaces of the display chamber 14. It is to be noted that reference numeral 15 denotes a handle attached to a central front surface of the door 12 in a vertical direction (longitudinal direction) on a non-support side (left side viewed from the front).

In a lower part of the main body 3, a machine chamber 18 is disposed, and grills 17 . . . (a periphery of the main body 3 is also covered with a panel 13) are attached to the periphery of the machine chamber. IN the machine chamber 18, there is disposed a compressor or a condenser (not shown) constituting a refrigerant circuit of a cooling device. A cooling chamber (not shown) having an opened upper surface is constituted in the insulating wall of the main body 3, and in this cooling chamber, there is disposed a cooler and a blower (not shown) constituting the refrigerant circuit. Moreover, a cold air discharge port 21 is constituted ranging from the front toward the rear on a right side viewed from the front of the main body 3, and a cold air suction port 22 is constituted ranging from the front toward the rear on a left side viewed from the front. The cold air suction port 22 communicates with a cold air suction side of the cooling unit in the cooling chamber, and the cold air discharge port 21 communicates with a cold air discharge side. Accordingly, in the cooling chamber, the cold air which has exchange heat with the cooling unit is discharged from the cold air discharge port 21 into the display chamber 14 by the blower, and the cold air in the display chamber 14 is sucked from the cold air suction port 22. Since the cold air is circulated in this manner, the inside of the display chamber 14 can be cooled at a predetermined refrigerating temperature.

Moreover, angles (not shown) are vertically disposed in four corners of a base 19 constituting a bottom surface of the machine chamber 18. On the other hand, reinforcing materials 23 (which reinforce the supports 7, 8, respectively) made of metals (steel plates) are attached to the front supports 7, 7 and the rear supports 8, 8, respectively. The respective reinforcing materials 23 are disposed in such a manner as to extend across front surfaces (outer surfaces) of the front supports 7, 7 and front surface (outer surface) of the ceiling wall 11, and rear surfaces (outer surfaces) of the rear supports 8, 8 and the rear surface (outer surface) of the ceiling wall 11, respectively, and entirely have a substantial gate shape. Lower ends of the reinforcing materials are fixed to the angles (rear reinforcing materials are not shown).

In the display chamber 14, three vertical stages of shelves 2, 2, and 2 for displaying the goods are bridged. In this case, shelf support portions 8A are formed on the front surfaces (surfaces on a display chamber 14 side) of the rear supports 8, 8, and a plurality of vertically crossing engagement holes 33 . . . are formed at predetermined intervals in the shelf support portions 8A. Shelf support portions 7A are also formed on mutually facing surfaces of the front supports 7, 7, and a plurality of vertically crossing engagement holes 34 . . . are formed at predetermined intervals in the shelf support portions 7A. Moreover, as described later, shelves 2 . . . engage with the engagement holes 33 formed in the rear supports 8 and the engagement holes 34 formed in the front supports 7, and are accordingly bridged.

On the other hand, the shelves 2 . . . are used as shelves capable of warming and dispensing the goods. That is, each shelf 2 comprises: a main body 24 constituted of a rectangular metal plate; and a frame member 26 which surrounds the periphery of the main body 24 and made of a hard resin. An electric heater (not shown) is attached to an inner surface of the main body 24. In a case where goods such as the canned beverage and the plastic-bottled beverage are warmed and dispensed on the shelves 2 . . . while upward cold air circulation from the bottom shelf 2 is stopped, electricity is conducted to the electric heater, and the goods on the main body 24 of each shelf 2 are warmed. It is to be noted that in FIG. 1, reference numeral 27 denotes dampers disposed on the top shelf 2 and the shelf 2 under the top shelf in a cold air passage constituted between the shelf 2 and the transparent wall 9 outside the shelf. When the dampers rotate, the cold air passage is opened/closed.

Moreover, reference numerals 31, 31 denote shelf receivers for bridging the shelf 2. When each shelf receiver 31 is screwed to a rear corner portion of a lower surface of the shelf 2, the shelf receiver 31 is attached to each of opposite rear sides of the lower surface of the shelf 2.

On the other hand, when the shelf receivers 31 on the opposite sides of a rear portion are inserted in and engaged with any of the engagement holes 33, and front-side engaging protrusions (not shown) protruding on the opposite sides of a front end of the shelf 2 are inserted in and engaged with the engagement holes 34, the shelf 2 is bridged in an inclined state in which a front part of the shelf is lowered.

It is to be noted that in the embodiment, three vertical stages of shelves are bridged in the display chamber 14, and the bottom-stage shelf 2 is used as a deck pan, and fixed to the front supports 7, 7 and the rear supports 8, 8 in the inclined state, not in the above-described bridging structure.

According to such constitution, bridging positions of the top-stage shelf 2 and the lower shelf 2 can be vertically moved, when changing the positions of the engagement holes 33, 34 to be engaged with the shelf receiver 31 and engaging protrusions 32.

It is to be noted that in FIG. 2, reference numeral 36 denotes storage grooves opened on front sides of the engagement holes 34 in the front supports 7, 7, and a lead wire 37 of the electric heater of each shelf 2 is stored in the storage groove 36 and lowers. Moreover, the lead wire is connected to an electric box 38 disposed in a right rear corner portion viewed from the front of the machine chamber 18 to connect the electric box 38 to each electric heater. The lead wire 37 from the top-stage shelf 2 is disposed in the storage groove 36 of the front support 7 on the right side viewed from the front, and the lead wire 37 from the lower-stage shelf 2 is disposed in the storage groove 36 of the front support 7 on the left side. Furthermore, storage portions 41, 41 opened upward are integrally formed in a front part of the case 6 of the main body 3, a remaining portion of the lead wire 37 of the top-stage shelf 2 is stored in the storage portion 41 on the right side viewed from the front, and the lead wire 37 from the lower-stage shelf 2 is stored in the storage portion 41 on the left side.

Next, a guard 43 for preventing the falling of the goods of the present invention will be described with reference to FIGS. 3 and 4. In the present embodiment, the guard 43 for preventing the falling of the goods comprises: a guard main body 44 constituted of a stria (metal fine rod) which is positioned above the front edge of the shelf 2 and which is constituted in such a manner as to extend between the front supports 7 and 7; and guard receivers 45, 45 detachably attached to opposite ends of the guard main body 44.

In the present embodiment, as shown in FIG. 4, the guard receiver 45 comprises: a guard holding portion 45A having an opening in a rear portion; an upper engaging claw (not shown) protruding on a front support 7 side of the guard holding portion 45A; and a lower engaging claw 45B formed in such a manner as to lower under the guard holding portion 45A and protrude on the front support 7 side. Here, it is assumed that an interval between the upper engaging claw and the lower engaging claw 45B formed in the guard receiver 45 is substantially equal to that between the adjacent engagement holes 34 formed in the front support 7, and these engaging claws can be disengageably engaged with the vertically adjacent engagement holes 34, 34.

According to such constitution, in a case where guard 43 for preventing the falling of the goods is attached, first the upper engaging claw of the guard receiver 45 is engaged with the engagement hole 34 of the front support 7 positioned in the height depending on the height dimension of the goods laid on the shelf 2. In this case, the lower engaging claw 45B of the guard receiver 45 is also engaged with the engagement hole 34 positioned under the engagement hole 34 engaged with the upper engaging claw. Accordingly, the guard receiver 45 can be securely fixed to the front support 7.

Thereafter, the opposite ends of the guard main body 44 are engaged with the guard holding portions 45A of the guard receiver 45. In this case, since the guard holding portion 45A is opened inwards with respect to the shelf 2 as described above, the guard main body 44 is inserted and engaged from an inner side of the shelf 2.

Accordingly, the guard main body 44 can be easily attached above the front edge of the shelf 2 by use of the engagement holes 34 formed beforehand for attaching the shelf 2. In this case, the guard main body 44 is constituted of a member separate from the shelf 2. Therefore, when the positions of the engagement holes 34 to be engaged with the guard receiver 45 are changed, the attaching position can be arbitrarily adjusted depending on the height of the goods laid on the shelf 2.

Therefore, unlike a conventional art, it is not necessary to dispose the guard for preventing the falling of the goods especially on the shelf. Even in a case where the goods having different height dimensions are displayed on the shelf 2, the height for attaching the guard 43 for preventing the falling of the goods is changed without changing the guard depending on the size of the goods. Accordingly, the goods falling prevention can be realized depending on the height of each of the goods.

Moreover, in the present embodiment, since the guard main body 44 is disengageably engaged with the front support 7 via the guard receiver 45, the guard main body 44 can be stably held in the engagement holes 34 of the front support 7. Consequently, the falling of the goods displayed on the shelf 2 can be prevented more securely.

Furthermore, even in a case where loads of the goods are applied to a front part such as a case where the shelf 2 is inclined lower in the front part and bridged to the front support 7 as in the present embodiment, the guard holding portion 45A formed in the guard receiver 45 is formed in such a manner as to open to an inner part of the shelf 2, that is, a rear part. Therefore, it is possible to avoid beforehand a disadvantage that the guard main body 44 is pushed forwards, and easily detaches from the guard receiver 45.

It is to be noted that in the present embodiment, the interval between the respective engaging claws formed on the guard receiver 45 is set to be equal to the invention between the vertically adjacent engagement holes 34 and 34. However, the interval may be set to be substantially equal to an interval between the engagement holes 34, 34 which are not adjacent to each other, that is, an interval between the engagement holes 34, 34 apart from each other every other or every two holes. In the present embodiment, two engaging claws are formed on the guard receiver 45, but the upper engaging claw may be formed, or more claws may be formed.

Figure 5:
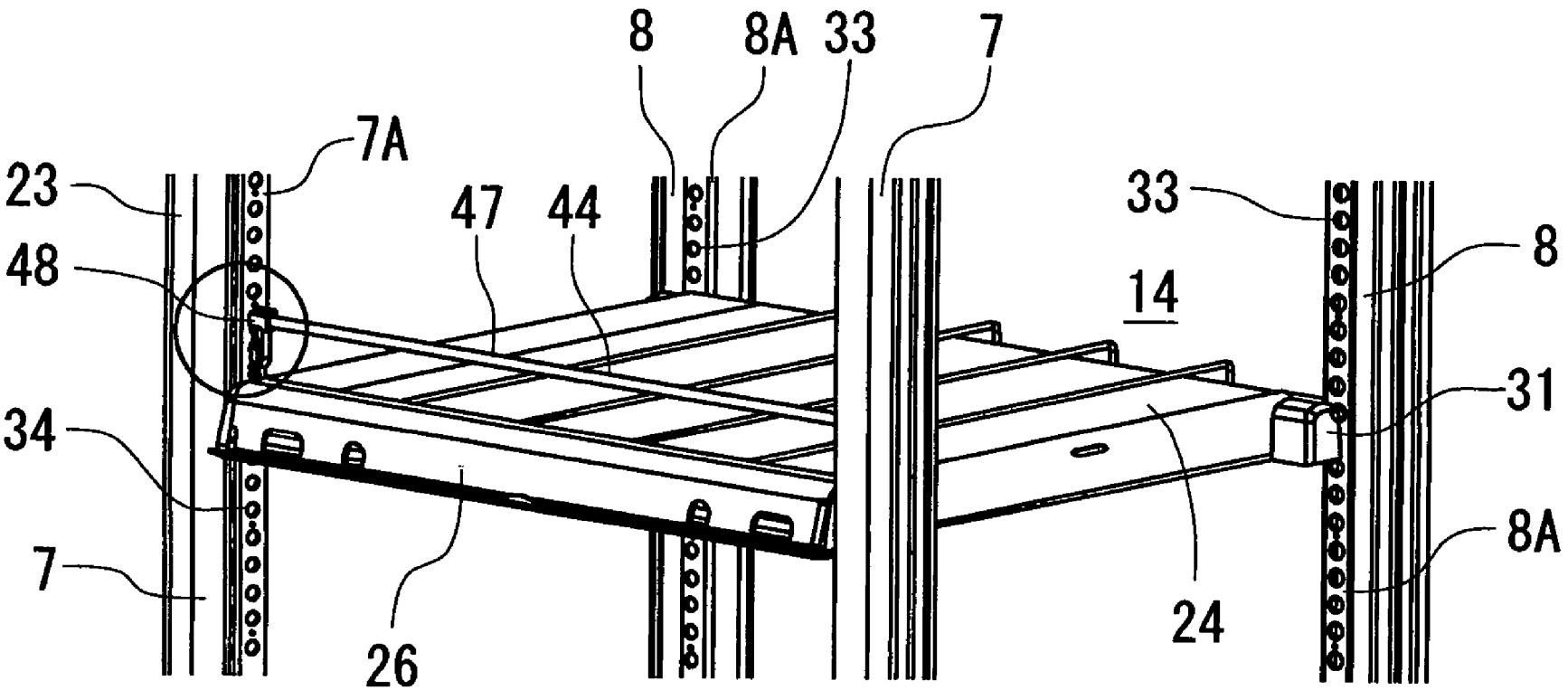
FIG. 5 is a partially enlarged perspective view of the showcase to which a guard of another embodiment is attached.

Next, a guard 47 for preventing falling of goods will be described according to another embodiment with reference to FIGS. 5 and 6. In the present embodiment, the guard 47 for preventing the falling of the goods comprises: a guard main body 44 similar to that of the above-described embodiment; and guard receivers 48, 48 detachably attached to opposite ends of the guard main body 44.

Figure 6:
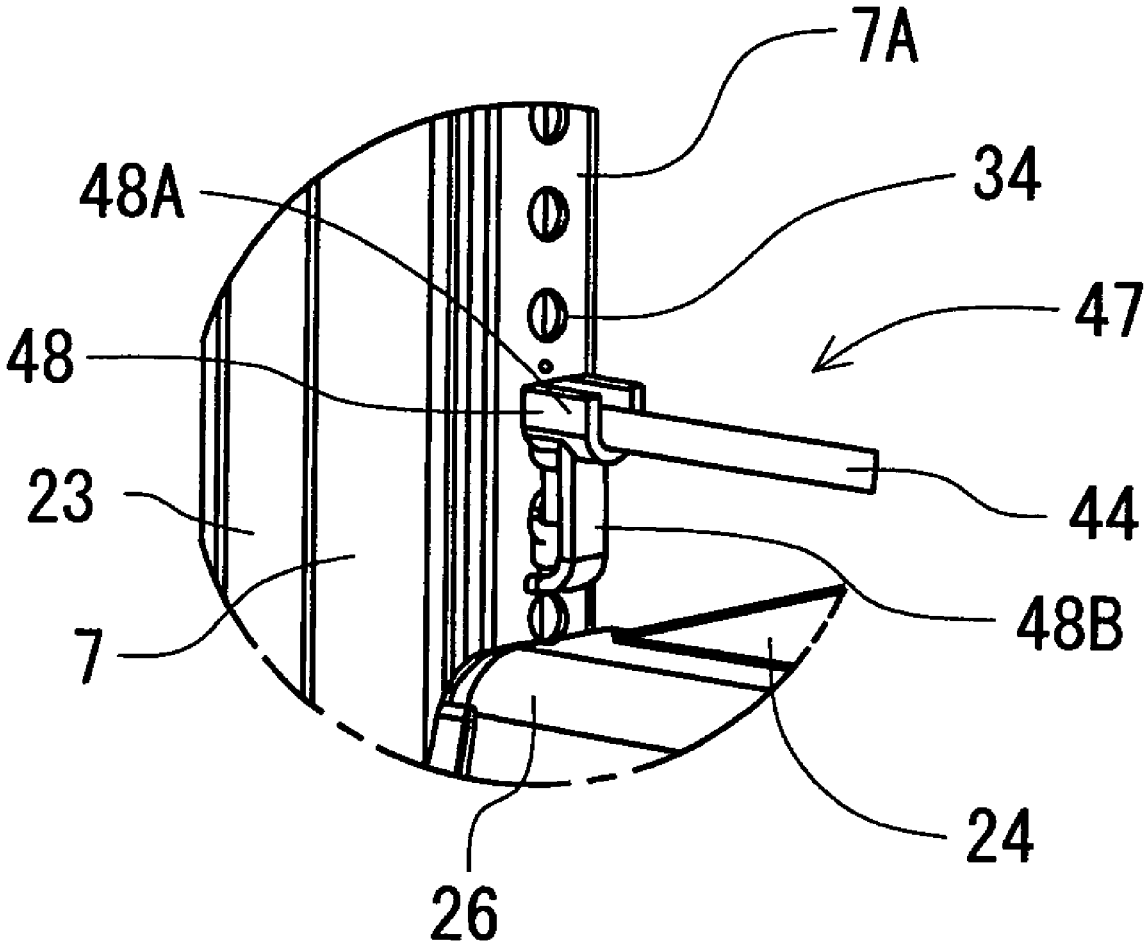
FIG. 6 is a partially enlarged diagram of FIG. 5.

As shown in FIG. 6, each guard receiver 48 comprises: a guard holding portion 48A having an upward opening; an upper engaging claw (not shown) formed in such a manner as to protrude on a front support 7 side of the guard holding portion 48A; and a lower engaging claw 48B formed in such a manner as to lower under the guard holding portion 48A and thereafter protrude on the front support 7 side. It is to be noted that an interval between the upper engaging claw and the lower engaging claw 48B formed on the guard receiver 48 is assumed to be similar to that in the guard receiver 45 of the above-described embodiment.

According to such constitution, in a case where the guard 47 for preventing the falling of the goods is attached, first the upper engaging claw of the guard receiver 48 is engaged with the engagement hole 34 of the front support 7 positioned in a height corresponding to the height dimension of the goods laid on the shelf 2.

Thereafter, the opposite ends of the guard main body 44 are engaged with the guard holding portions 48A of the guard receivers 48. In this case, since the guard holding portion 48A is formed in such a manner as to open upwards as described above, the guard main body 44 is inserted from above the shelf 2 to engage the body.

Consequently, even in the present embodiment, the guard main body 44 can be easily attached above the front edge of the shelf 2 by use of the engagement holes 34 formed beforehand for attaching the shelf 2. In this case, the guard main body 44 is constituted of a member separate from the shelf 2. Therefore, when the positions of the engagement holes 34 to be engaged with the guard receiver 48 are changed, the attaching position can be arbitrarily adjusted depending on the height of the goods laid on the shelf 2.

Therefore, unlike a conventional art, it is not necessary to dispose the guard for preventing the falling of the goods especially on the shelf. Even in a case where the goods having different height dimensions are displayed on the shelf 2, the height for attaching the guard 47 for preventing the falling of the goods is changed without changing the guard depending on the size of the goods. Accordingly, the goods falling prevention can be realized depending on the height of each of the goods.

Moreover, in the present embodiment, since the guard main body 44 is disengageably engaged with the front support 7 via the guard receiver 48, the guard main body 44 can be stably held in the engagement holes 34 of the front support 7. Consequently, the falling of the goods displayed on the shelf 2 can be prevented more securely.

Furthermore, in the present embodiment, since the guard holding portion 48A formed on the guard receiver 48 is formed in such a manner as to open upwards, the guard main body 44 can be easily detached from the guard holding portion 48A still in a state in which the goods are displayed on the shelf 2. While the goods remain to be displayed, it is possible to change the height of the guard 47 for preventing the falling of the goods.

Figure 7:
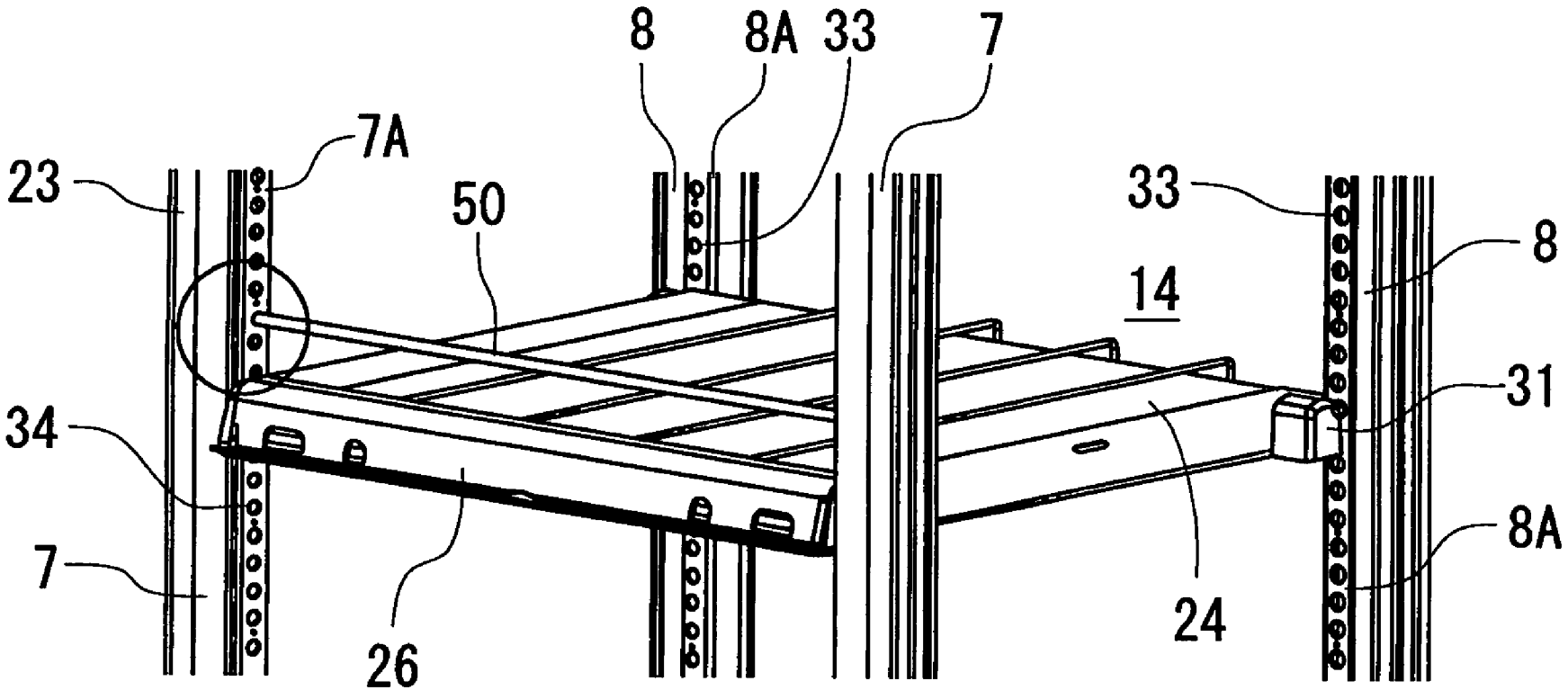
FIG. 7 is a partially enlarged perspective view of the showcase to which a guard of still another embodiment is attached.
Figure 8:
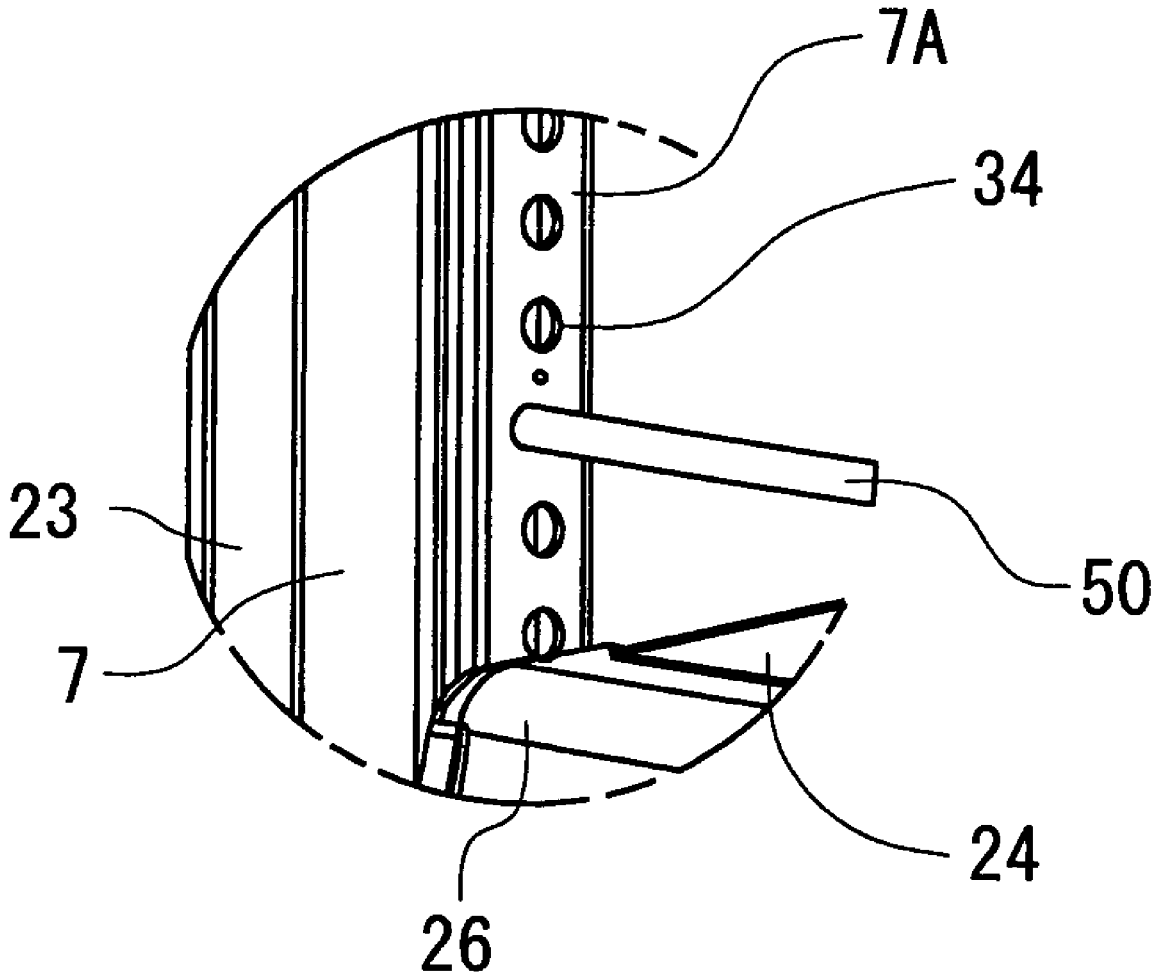
FIG. 8 is a partially enlarged diagram of FIG. 7.
Figure 9:
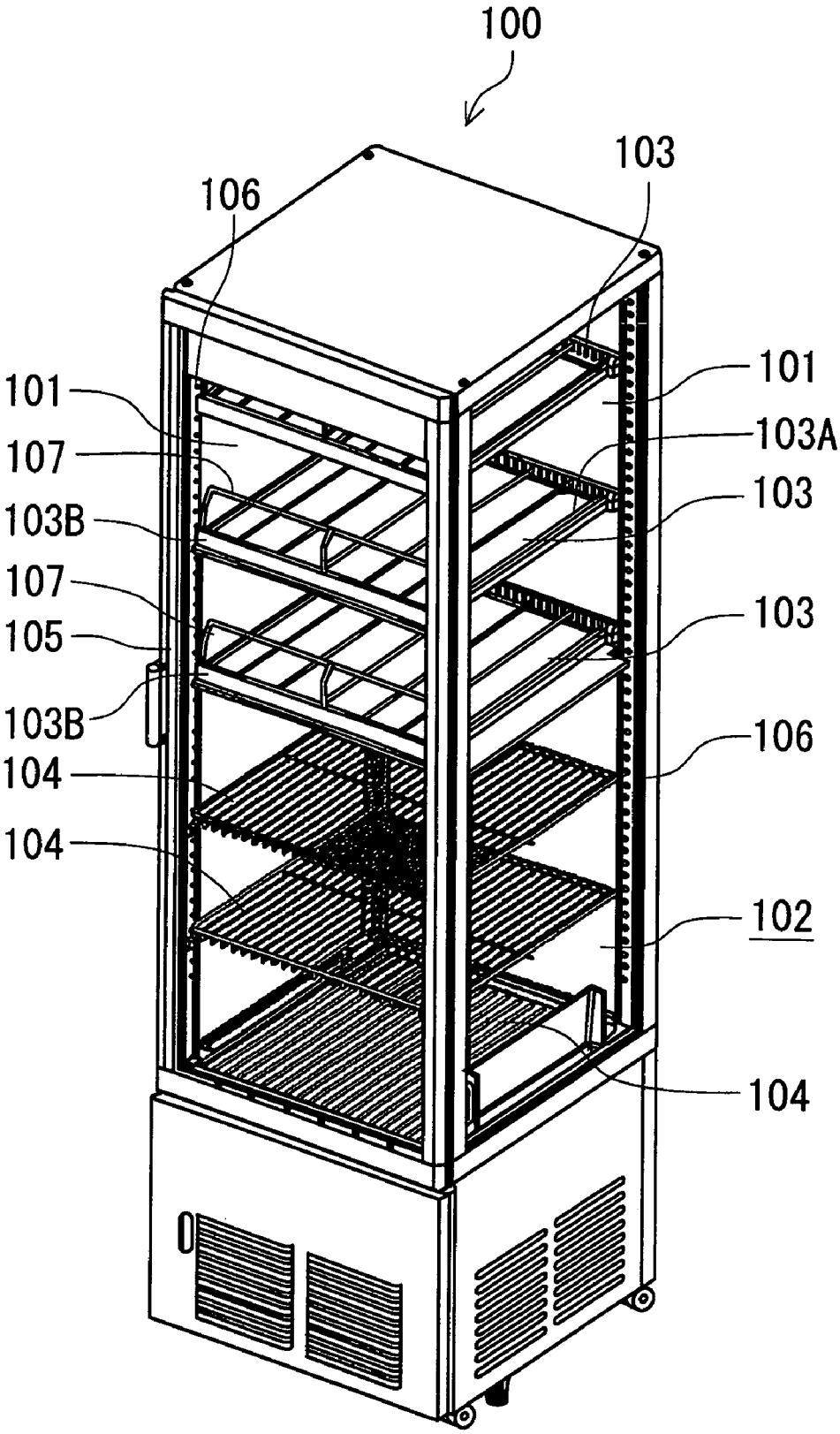
FIG. 9 is a perspective view of a conventional showcase.

Next, a guard 50 for preventing falling of goods will be described according to still another embodiment with reference to FIGS. 7 and 8. In the present embodiment, the guard 50 for preventing the falling of the goods comprises a stria (metal fine rod) which is positioned above a front edge of a shelf 2 and which is constituted in such a manner as to extend between front supports 7 and 7. It is to be noted that a sectional dimension of such stria is such a dimension as to be detachably insertable/engageable with respect to engagement holes 34 formed in the front support 7.

According to such constitution, in a case where the guard 50 for preventing the falling of the goods is attached, for example, while one end portion of the guard is inserted in the engagement hole 34 formed in one front support 7, the guard 50 is bent utilizing elasticity of the guard, and the other end portion is inserted in the engagement hole 34 formed in the other front support 7 to thereby achieve the attaching.

Accordingly, even in the present embodiment, the guard 50 can be easily attached above the front edge of the shelf 2 by use of the engagement holes 34 formed beforehand for attaching the shelf 2. In this case, the guard 50 is constituted of a member separate from the shelf 2. Therefore, when the positions of the engagement holes 34 with respect to which the guard is to be inserted and engaged are changed, the attaching position can be arbitrarily adjusted depending on the height of the goods laid on the shelf 2.

Therefore, unlike a conventional art, it is not necessary to dispose the guard for preventing the falling of the goods especially on the shelf. Even in a case where the goods having different height dimensions are displayed on the shelf 2, the height for attaching the guard 50 for preventing the falling of the goods is changed without changing the guard depending on the size of the goods. Accordingly, the goods falling prevention can be realized depending on the height of each of the goods.

It is to be noted that in each embodiment, the examples of the four glass surfaces type showcase have been described above, but the present invention is not limited to them, and is effective for general showcases having shelves.

What is claimed is:

1. A showcase constituted of shelves for displaying goods, which are bridged to supports comprising a plurality of vertically ranging engagement holes, the showcase comprising:

a guard for preventing falling of the goods, which is disposed above an edge portion of each shelf, wherein the supports are disposed in the corners of a base constituting a bottom of the showcase, wherein said supports being disposed next to an opening of the showcase are front supports and the other two supports are rear supports, the shelves are bridged to the supports using shelf receivers, and the guard for preventing the falling of the goods is detachably attached to the engagement holes of the front supports independently from each shelf; and the shelf receivers are engaged with the engagement holes of the supports.

2. The showcase according to claim 1, wherein the guard for preventing the falling of the goods comprises:

a guard main body extending over a longitudinal direction of each shelf; and a guard receiver which receives the guard main body, wherein the guard receiver is detachably attached to the engagement holes.

3. The showcase according to claim 2, wherein the guard receiver comprises: a plurality of engaging claws engaged with the plurality of engagement holes, respectively.

4. The showcase according to claim 2 or 3, wherein the guard receiver has a guard holding portion which holds the guard main body, and the guard holding portion opens toward the inside of the shelf to hold the guard main body.

5. The showcase according to claim 2 or 3, wherein the guard receiver has a guard holding portion which holds the guard main body, and the guard holding portion opens upwards to hold the guard main body.

6. The showcase according to claim 1, wherein the guard is made of bendable material, such that it is inserted into the engagement holes by bending the guard utilizing the elasticity of the guard and inserting ends of the guard into the engagement holes to achieve attachment.

* * * * *